United States Patent [19]

Wolf

[11] 4,030,645

[45] June 21, 1977

[54] CLOTHING DISPLAY FORM

[76] Inventor: Morris A. Wolf, 7048 Macapa Drive, Los Angeles, Calif. 90068

[22] Filed: June 28, 1976

[21] Appl. No.: 700,469

[52] U.S. Cl. ..... 223/68
[51] Int. Cl.[2] ..... A41H 5/00
[58] Field of Search ..... 223/66, 67, 68, 72, 223/71, 73; 46/161, 163; 33/15, 17 R

[56] References Cited

UNITED STATES PATENTS

| | | | |
|---|---|---|---|
| 2,204,876 | 6/1940 | Williamson | 223/68 |
| 2,279,517 | 4/1942 | Oestricher | 223/68 |
| 3,740,894 | 6/1973 | Howland et al. | 46/461 |
| 3,833,158 | 9/1974 | Cavrich | 223/68 |

FOREIGN PATENTS OR APPLICATIONS

| | | | |
|---|---|---|---|
| 199,348 | 9/1923 | United Kingdom | 223/68 |

*Primary Examiner*—G. V. Larkin
*Attorney, Agent, or Firm*—Fulwider, Patton, Rieber, Lee & Utecht

[57] ABSTRACT

A form for displaying clothing designed to be worn on the upper portion of the human body, and having a torso-shaped section mounted on a stand and provided with removable arm sections. Each of the arm sections has a stud adjacent its upper end that is inclined laterally away from and downwardly with respect to the arm section, and the torso section has sockets that receive the studs and cooperate in guiding the arm sections into the desired position relative to the torso section. The arm sections are composed of relatively rigid material having slick outer surfaces shaped to the desired final shape of the arms of the clothing to be displayed. Thus, as the display form is dressed, the weight and slickness of the arm sections facilitate insertion of the sections in the clothing, and the cooperating studs and sockets position the arms in the desired positions relative to the torso section. An optional removable dickey is contoured in the shape of clothing worn beneath an outer garment, simulating a shirt collar and front, and a tie. Alternatively, a removable neck cap is provided for the torso section for use when an article of actual clothing, such as a sweater, is displayed with a coat.

11 Claims, 9 Drawing Figures

CLOTHING DISPLAY FORM

FIELD OF THE INVENTION

The present invention relates to clothing forms used to display sleeved garments in a manner designed to simulate their appearance during actual wear, and more particularly, to a display form for use in displaying coats.

DESCRIPTION OF THE PRIOR ART

In the past, clothing display forms having torso sections with arms hanging from the sides thereof have been used in the display of men's clothing, particulary jackets, sport coats, suit coats and the like. The attractive display of the clothing in a natural posture as it might be worn is highly desirable in order to provide a high degree of merchandising appeal.

In the past, such display forms typically employed a torso-shaped section formed of papier-mache or some other material which was easily punctured with straight pins, and soft and flexible arm pads where provided for insertion in the sleeves of the garments to be displayed. These arm pads were equipped with tabs which were pinned onto the shoulders of the torso section. Prior to such attachment, however, the arm pads were stuffed down the sleeve of the garment to be displayed, and thereafter were pinned onto the shoulders of the torso section on top of any shirt or other undergarment already mounted on the torso section. The soft arm pads utilized were typically formed of paper or cloth, and could be inserted and properly positioned in the sleeves of the garment only with some difficulty.

The arrangement of clothing on such display forms required considerable skill and expertise, which usually were provided by a specialist known as a "rigger". The rigger performed the time-consuming job of fitting the pads in the arm sections and attaching them to the torso section, in a manner which displayed the clothing in a natural posture and appearance. Sometimes the rigger had to stuff the sleeve with tissue paper to produce a more natural contour, and frequently the lining of the garment to be displayed was ripped out to obtain a proper fit. In short, the rigging operation with conventional clothing forms was time-consuming and required a skilled specialist, and therefore was an expensive operation.

SUMMARY OF THE INVENTION

The present invention greatly simplifies the process of arranging garments on a clothing display form, by providing a clothing display form which requires minimal time and skill to effect the arrangement of garments thereon. This is achieved by utilizing rigid arm sections which have the desired final shape of the clothing sleeves, and have relatively smooth or slick outside surfaces to slip readily into place in the sleeves, and mounting the arm sections on the torso section by means of cooperating studs and sockets which guide the arm sections into the proper positions as an incident to the insertion of the studs in the sockets. The studs are attached to the arm sections near the upper ends thereof, and are inclined laterally and downwardly, and the sockets are shaped to freely receive the studs and guide them, and the arm sections, into the desired positions.

Thus, the arm sections are merely inserted into the sleeves of a garment, such as a sport coat, and are held temporarily in approximately the final positions by the studs, which catch in the arm holes. The sockets are located immediately below the shoulders of the torso section, and are defined by inwardly and downwardly inclined annular flanges that receive the studs of the arm sections. The undersides of the studs, and the upper sides of the socket flanges, are shaped so that insertion of the studs into the arm sockets, after the arm sections have been positioned within the sleeves of the garment, produces a self-engaging effect; that is, the weight of the arm sections serves to seat the studs in the sockets and position the arm section on the torso section. The studs are positioned below the upper ends of the arm sections, and these upper ends are shaped and positioned, in the final assembly, to provide proper support for the shoulder portions of the garment. In the preferred embodiment, the studs are generally elliptical in cross-section, having the same curvature and downward incline as the studs. Thus, preparation for the display of a garment requires only seconds, which is in marked contrast to the time-consuming preparation required with prior art display forms.

An optional feature of the present invention is a removable dickey section which simulates the collar and front of a shirt, and a necktie. This dickey section may be a one-piece molding, and has an upper, socket-end portion shaped to fit over the neck of the torso section, and a depending body portion which overlies the front central portion of the torso section, being contoured to lie flat against the torso section. This body portion has an outer, or front, side which simulates a shirt front and necktie in an artistic fashion. The dickey section also may be designed to simulate other types of clothing.

When display of a garment with a simulated shirt and tie is desired, the dickey section is fitted onto the form, preferably before the main garment is in place, thus eliminating the need for a real shirt and tie, and saving the installation time required. If an actual shirt or sweater is preferred, it can be used, preferably with a neck cap that finishes the neck of the torso section in an attractive manner.

DESCRIPTION OF THE EMBODIMENT

Figure 1:
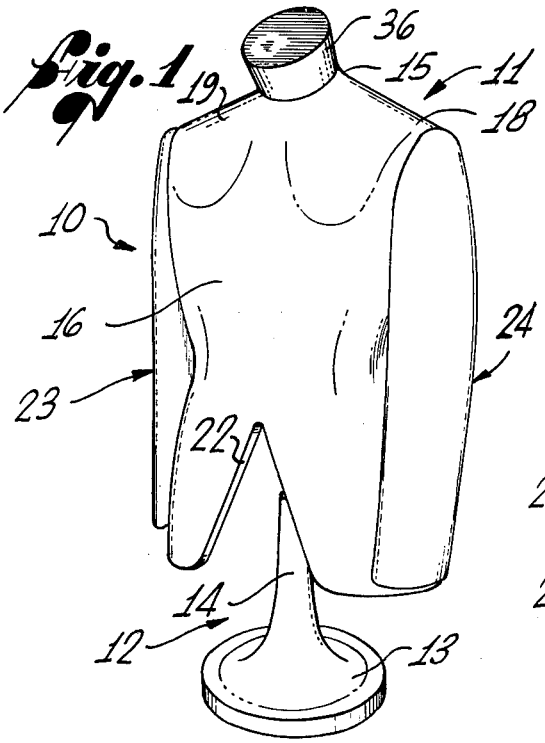
FIG. 1 is a perspective view of a display form in accordance with the invention.
Figure 2:
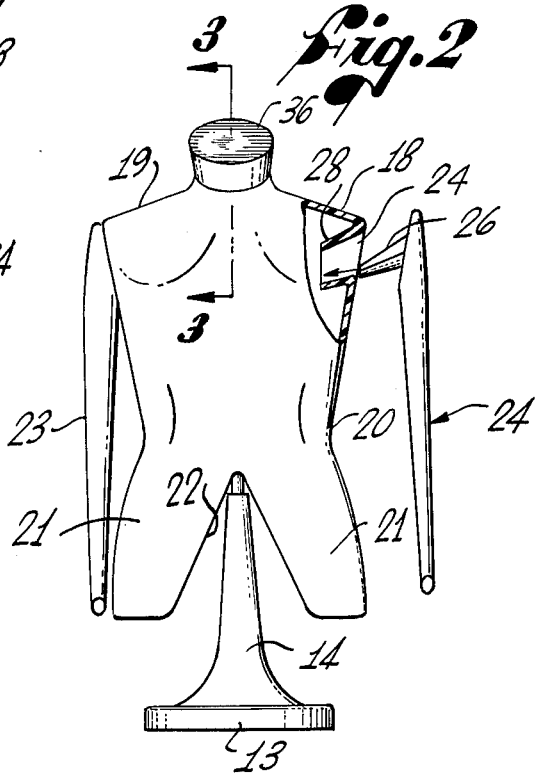
FIG. 2 is a front elevational view of the display form, partially broken away and shown in cross section, with one of the arm sections removed from its socket.

Referring now to the drawings, a clothing display form 10 is illustrated in which a smooth surfaced, rigid torso section 11, shaped in the form of the upper portion of the trunk of a human body, is mounted upon a stand 12. The stand 12 has a base 13, the lower extremity of which is a disk upon which the torso structure is supported by an upwardly tapering center post 14.

Figure 3:
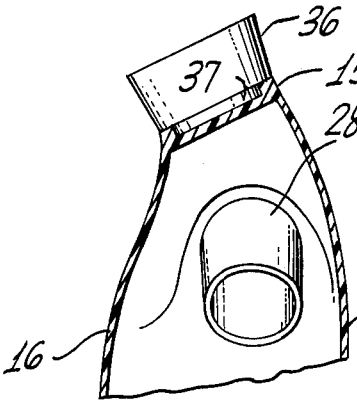
FIG. 3 is an enlarged fragmentary sectional view taken along the line 3—3 of FIG. 2.

The torso section 11 has a short, generally circular neck 15 at the center of its upper extremity, a chest wall 16, and a back wall 17, both disposed in mutually opposing relationship and in generally upright alignment to simulate the geometry of the chest and back of a human being, as indicated in FIG. 3. The chest wall 16 and back wall 17 are joined to each other in the upper regions of the torso 10 by arcuate walls forming shoulders 18 and 19, and are joined together around the sides of the torso by side walls that are tapered in the midriff area to form a waist, as indicated at 20. The lower portion of the torso section flares outwardly somewhat, in the area denoted as 21, to resemble the hip contour of a human being, and a front notch 22 preferably is provided in the lower central portion of the front of the torso.

Figure 4:
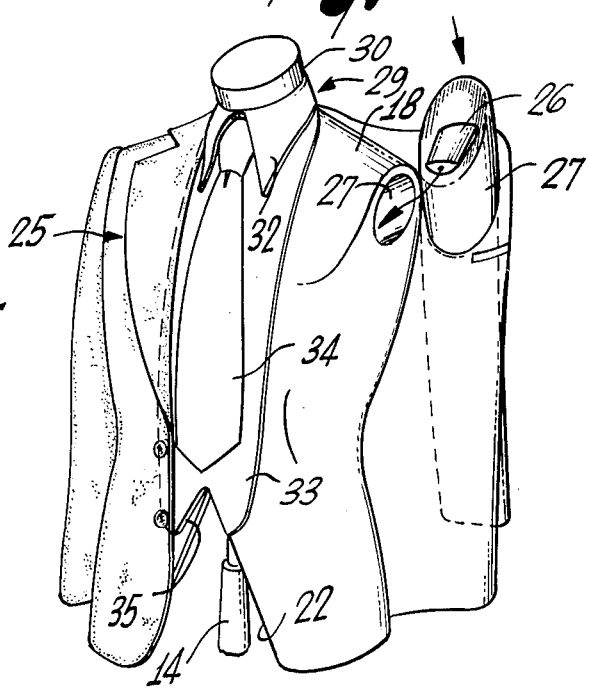
FIG. 4 is a fragmentary perspective view similar to FIG. 1, with a sport coat and a dickey section on the form, and illustrates the manner of arranging the coat for display.

The display form 10 also has two elongated arm sections, a right-hand section 23 and a left-hand section 24, both of which are detachable from the torso section 11 to facilitate insertion in the sleeves of a garment to be displayed on the form, and also to facilitate placement of the garment on the torso section. An illustrative garment is shown in FIG. 4 as a sport coat 25. The arm sections serve to fill out the sleeves of the garment, and to hold them in a desired configuration for attractive display.

As previously mentioned, the arm sections of conventional display forms typically have been pads composed of soft material such as cloth or paper, so as to be capable of being stuffed into sleeves and shaped generally to a desired configuration, being pinned into the sleeves and also pinned to the torso section at the shoulders. The installation and proper shaping and positioning of such pads has been a time-consuming operation requiring the services of a skilled specialist.

In accordance with the present invention, the arm sections 23 and 24 are composed of relatively rigid material having smooth and relatively slick outside surfaces providing the desired shape of the sleeves, and are removably supported on the torso section 11 by specially designed pin-and-socket connections which cooperate not only to suspend the arm sections from the torso section but also to position the arm sections and the garment sleeves rapidly and properly relative to the torso section. In addition, the connections have components which position the arm sections preliminarily in the sleeves, prior to installation of the arm sections on the torso section. Thus, the arm sections may be simply slipped into the sleeves of a garment, and then coupled to the torso section by means of the pin-and socket connections while the garment is draped around the torso section, and little, if any, additional shaping or arranging is required to complete the arrangement of the garment for display.

More specifically, the arm sections 23 and 24 of the display form 10 are elongated parts, slightly shorter than the length of the sleeves of the garment to be displayed, and having a total cross-sectional area calculated to substantially fill, but not overfill, the insides of the sleeves. The preferred cross-sectional shape is generally elliptical, but with flattened sides for attractive display of the sleeves, and the lateral thickness increases progressively from the lower end toward the upper end in a manner corresponding to the tailoring of the garments to be displayed. It should be noted that the usual sample size in men's sport coats is size 40, so the form 10 typically will be designed to accommodate this size.

To form the pin-and-socket connections, each arm section 23, 24 has, on the inner side adjacent its upper end, a transversely extending and downwardly inclined stud 26, and the torso section 11 has two socket openings 27 in its sides, directly below the shoulders 18 and 19, for receiving the studs 26. These socket openings are circular in shape, and are defined by the outer ends of two annular sleeves or flanges 28 that are inclined inwardly and downwardly into the torso section from the socket openings, toward the center of the torso section between the chest wall 16 and the back wall 17. The positions of the socket openings in the torso section correspond to the positions of the upper ends of arm openings into the sleeves of the garment to be displayed.

Figure 7:
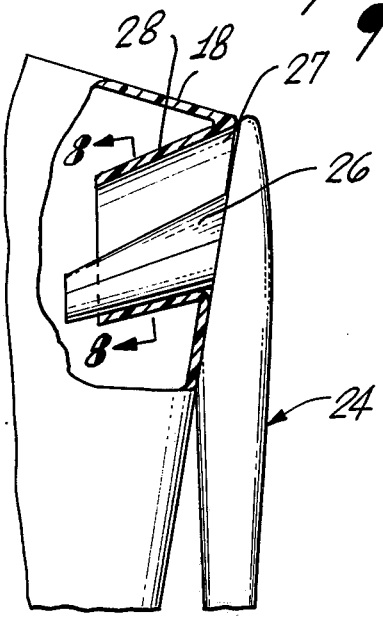
FIG. 7 is an enlarged fragmentary view similar to part of FIG. 2, with the arm section in place in its socket.
Figure 8:
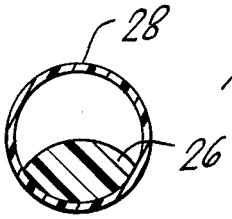
FIG. 8 is a sectional view taken along the line 8—8 of FIG. 7.

The preferred configuration of the studs 26, shown most clearly in FIGS. 7 and 8, is an oblong or generally elliptical cross-section, which is substantially smaller than the socket opening 27 and tapers from the arm section 23, 24 inwardly to a free stub end. The outside curvature of the underside of the stud preferably is the same as the inside curvature of the lower side of the socket flange 28, for full nesting engagement as shown in FIGS. 7 and 8. The configuration of the upper side of the stud is not important from a functional viewpoint, but preferably is generally the same as the underside.

Each stud 26 is spaced below the upper end of the arm section 23, 24 a preselected distance, so that the underside of the stud, at its juncture with the arm section, is spaced below the upper end of the end arm section a distance that is the same as, or slightly greater than, the distance from the lower side of the socket opening 27 to the end of the shoulder above the opening. Thus, the upper end of the arm section is supported even with, or slightly above, the end of the shoulder, as shown in FIG. 7, when the stud is fully in the socket opening, for proper simulation of the shoulder configuration in the assembled form.

The angle of the studs relative to the longitudinal axes of the arm sections is substantially less than ninety degrees, and preferably more than 45°. The illustrative angle is on the order of 70° to 80°.

When the studs 26 are inserted in the socket openings 27 and the arm sections 23 and 24 are released, the weight of the arms, acting on the downwardly inclined studs, tends to force the studs into the socket openings and along the downwardly inclined flanges until the arm sections abut against the torso section 11 around the socket openings. This action, together with the complementary curvatures of the engaged surfaces of the studs and socket openings, produces a self-seating action of the arm sections relative to the torso section.

Moreover, with relatively rigid and slick-surfaced material used for the arm sections 23 and 24, the latter can be slipped quickly and easily into the sleeves of a garment, through the upper ends of the arm openings in the sleeves, and their weight will cause them to gravitate into the proper positions in the sleeves. In this operation, the studs serve as "catches", engaging the upper ends of the arm openings in the garment to prevent the arm sections from passing through, or too far into, the sleeves.

Accordingly, the arm sections may be inserted in the garment prior to placing it on the torso section 11, or after the garment has been draped over the shoulders of the torso section. In either event, after the arm sections are in the sleeves, each section is simply moved into position alongside the torso section, its stud is fitted into the socket opening, and the arm section is released. At this stage, the self-seating action moves both the arm section and the sleeve to the desired final positions.

Figure 9:
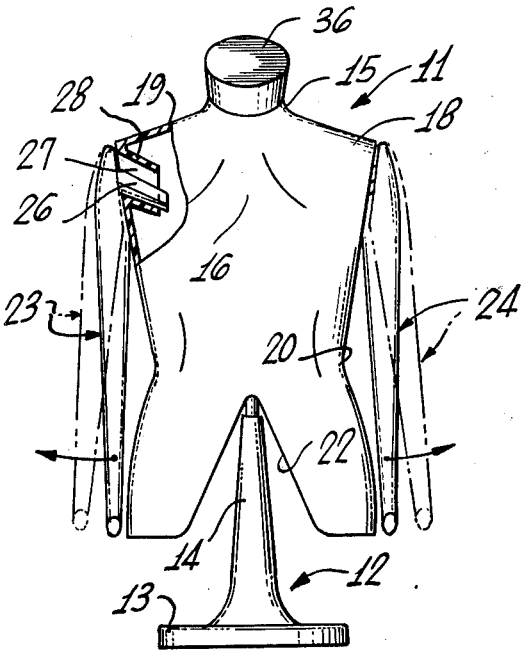
FIG. 9 is a front elevational view similar to FIG. 2, with another portion broken away.

To complete the "rigging" operation, it may be desirable to swing the lower ends of the arm sections 23 and 24 momentarily away from the torso section 11, as permitted by the loose fit of the studs 26 in the socket openings 27, and as shown in dot-dash lines in FIG. 9. This swinging flexes the garment and then permits it to settle naturally around the display form. Beyond this, nothing should be required except, perhaps, buttoning of a coat or smoothing of a collar.

The torso section 11 and the arm sections 23 and 24 preferably are of hollow construction, and may be formed of rotationally cast, polyurethane foam, which cures in a rigid condition and which has a slick outer surface. The slick surface may be achieved either by employing self-skinning foam, or by utilizing polyurethane foam which does not contain a blowing agent to any appreciable degree. The wall thickness of the torso section 11 and arm sections 23, and 24 typically will be about 0.25 inches or less. Such structures have sufficient strength to withstand prolonged use, are very light in weight, and will accept pins as aids in positioning clothing, if desired.

Figure 5:
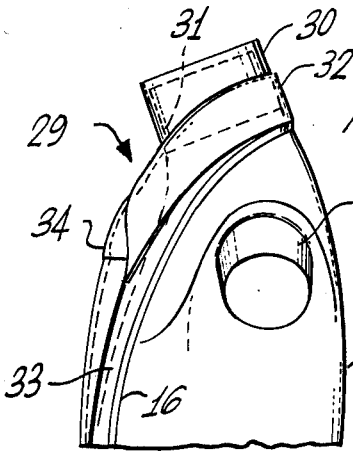
FIG. 5 is a fragmentary sectional view similar to FIG. 3, with the dickey section on the torso section.
Figure 6:
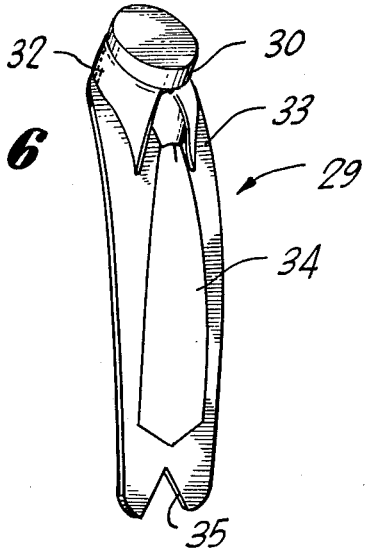
FIG. 6 is an isolated perspective view of the dickey section.

As an optional but desirable feature, the present invention also provides a removable dickey section 29 (FIGS. 4–6) for simulating a shirt and tie, or other auxiliary clothing, and eliminating the need for actual dressing of the form with such incidental items. For quick and secure mounting of the dickey section on the form, a circular neck extension 30 is formed at its upper end with a downwardly opening recess 31 (FIG. 5) that fits in mating engagement over the neck 15 of the torso section 11, to hold the dickey in position.

Around the neck extension 30 is a simulated shirt collar 32, and depending from the neck extension and the collar, on one side, is an elongated, rigid panel or flap 33 which has an outside surface that is contoured to simulate a shirt front and a necktie 34. The underside of this flap conforms to the contour of the chest wall 16 and extends from the simulated collar 32 down the front of the torso section 11, having a width sufficient to cover the portion of the torso section that is exposed when the garment is in place, and a length that preferably is the same as the length of the central portion of the front of the torso section. The lower end preferably is notched at 35 to match the notch 22 in the torso section. The dickey section preferably is a one-piece plastic molding, and thus can be mass-produced in a variety of configurations with highly artistic designs.

When a sport coat 25 is to be displayed on the form 10, the dickey section 29 is positioned with the neck extension 30 directly over the neck 15 of the torso section 11. The sport coat then is mounted for display, in the manner that has been described. Alternately, if an actual shirt and necktie, or other garments, are to be displayed with the coat, the dickey section is replaced with a decorative neck cap 36, which seats within a circular recess 37 formed within the neck 15 of the torso section 11, as most clearly seen in FIG. 3. With the neck cap 36 in position, support is provided for the collar of an actual fabric shirt displayed on the form 10, and an actual necktie can be tied in a conventional manner within the shirt collar. Similarly, the neck cap can be used when a sweater is displayed beneath the sport coat.

From the foregoing, it will be evident that the present invention provides a clothing display form upon which a garment, particularly a men's suit coat or sport coat, may be quickly and easily mounted, without need for any specialized skills, and with which the positioning of the garment on the arm sections, and of the latter on the torso section, are effected by the display form itself, as an incident to the fitting of the arm sections in the sleeves and the placement of the studs 26 in the socket openings 27. The optional dickey section further simplifies the dressing of the display form, and in fact, is regarded as providing an artistic simulation that is superior in some respects to an actual shirt and necktie.

It also will be evident that, while the presently preferred embodiment of the invention has been illustrated and described in detail, various modifications and changes may be made within the spirit and scope of the invention.

I claim:

1. A clothing display form for a sleeved garment such as a sport coat, comprising:

a torso-shaped section simulating the upper portion of a human body, including the shoulders thereof;

two elongated arm sections composed of relatively rigid and smooth-surfaced material shaped to substantially fill the sleeves of the garment and having a preselected shape for holding the sleeves in the same shape, said arm sections having upper end portions positionable alongside the shoulder-simulating portions of the torso-shaped section;

said torso-shaped section having two generally circular socket openings in its opposite sides immediately below the shoulder-simulating portions thereof, and having annular flanges extending inwardly from said socket openings and inclined downwardly therefrom into the torso-shaped section;

and a stud on each of said arm sections positioned to project laterally from the side adjacent said torso-shaped section into the socket opening, said studs being spaced below the upper ends of said arm sections to position said upper ends relative to the shoulder-simulating portions, and being inclined downwardly and inwardly at an angle corresponding to the incline of said flanges, and the undersides of the studs being curved surfaces cooperating with the flanges to position the arm sections in preselected positions relative to the torso-shaped section as an incident to the engagement of the studs and the flanges;

said socket openings being substantially larger in area than the cross-sectional area of said studs to permit rapid positioning of the arm sections in the sleeves of a garment and alongside the torso section with the studs inserted in the socket openings, and to gravitate into correct positions relative to the torso section, and also to permit free swinging of the arm sections relative to the torso section while in a sleeved garment, whereby the garment can be quickly arranged on the form.

2. A clothing display form as defined in claim 1 in which said socket openings are circular and said studs have smaller, generally elliptical cross-sections with undersides of the same curvature as said flanges.

3. A clothing display form as defined in claim 1 in which said torso-shaped section has a neck stub between said shoulder-simulating portions, and further including a removable dickey section having a neck extension fitting over said neck stub, a front panel depending therefrom along the front of said torso-shaped section, and means on said dickey section artistically simulating clothing worn with the sleeved garment.

4. A clothing display form as defined in claim 3 in which said clothing simulating means comprise a simulated shirt collar around said neck extension, a simulated shirt front on said front panel, and a simulated necktie over said simulated shirt front.

5. A clothing display form as defined in claim 1 in which said torso-shaped section and said arm sections are hollow plastic moldings.

6. A clothing display form for a sleeved garment, comprising:

a torso section shaped in the form of the upper portion of the torso of a human body, including two shoulders, and an enlarged socket opening in the side of the torso section below each of said shoulders;

and two elongated arm sections composed of relatively rigid and smooth-surfaced material and having preselected shapes for shaping the sleeves of the garment, each of said arm sections having a mounting stud on one side thereof projecting laterally and downwardly at a preselected angle for engagement with the wall of one of said socket openings, to suspend the arm section on said torso section in a preselected position as an incident to insertion of the mounting stud into the socket opening and release of the arm section;

said socket openings being substantially larger in area than the cross-sectional area of said studs to permit rapid and easy positioning of the arm sections alongside the torso section, and having lower sides shaped to cooperate with the studs in positioning the arm sections by gravity generally in the proper position relative to the torso section while permitting swinging of the arm sections to facilitate arrangement of the garment.

7. A clothing display form as defined in claim 6 in which said socket openings are defined by the outer ends of inwardly extending annular flanges that are inclined downwardly at approximately the same angle as said studs and have concavely curved lower sides.

8. A clothing display form as defined in claim 7 in which the undersides of said studs are convex and have substantially the same curvature as the lower sides of said flanges.

9. A clothing display form as defined in claim 6 in which said torso section has a neck stub between said shoulders, and further including a removable dickey section having a neck extension for fitting over said neck stub and holding the dickey section on the form, and a front panel depending from said neck extension along the front of said torso section and artistically simulating clothing worn with the sleeved garment.

10. A clothing display form as defined in claim 9 in which said front panel comprises a simulated shirt collar around said neck extension, a simulated shirt front, and a simulated necktie over said simulated shirt front.

11. A clothing display form as defined in claim 9 in which said dickey section is a one-piece plastic molding.

* * * * *